United States Patent [19]

Frazzell et al.

[11] Patent Number: 4,789,303

[45] Date of Patent: Dec. 6, 1988

[54] MARINE PROPELLER CARRY HANDLE AND EMERGENCY SPARE KIT

[75] Inventors: Michael E. Frazzell, Neenah; Roger E. Koepsel, Oshkosh; William J. Gius, Fond du Lac, all of Wis.

[73] Assignee: Brunswick Corporation, Skokie, Ill.

[21] Appl. No.: 136,861

[22] Filed: Dec. 22, 1987

[51] Int. Cl.[4] ..... B63H 1/20; B63H 5/18

[52] U.S. Cl. ..... 416/63; 416/84; 416/146 R; 416/244 B

[58] Field of Search ..... 416/63, 62, 146 R, 146 A, 416/146 B, 146 B, 244 B, 84, 86, 241 A, 248, 245 A, 247 A; 294/15, 158

[56] References Cited

U.S. PATENT DOCUMENTS

| | | | |
|---|---|---|---|
| 1,635;259 | 7/1927 | Critchley | 294/15 X |
| 1,675,087 | 6/1928 | Biersach | 416/146 B |
| 2,398,896 | 4/1946 | Simmons et al. | 294/158 |
| 2,543,879 | 3/1951 | Stuckey | 416/84 X |
| 2,606,054 | 8/1952 | Cole | 294/15 |
| 2,632,354 | 3/1953 | Black | 416/146 R |
| 3,095,044 | 6/1963 | Medlock | 416/146 B X |
| 3,224,509 | 12/1965 | Thompson | 416/241 A X |
| 3,245,476 | 4/1966 | Rodwick | 416/244 B X |
| 3,307,634 | 3/1967 | Bihlmire | 416/241 A X |
| 3,378,183 | 4/1968 | Ferrer | 294/158 |
| 3,405,765 | 10/1968 | Herbert | 416/86 X |
| 3,701,611 | 10/1972 | Lambrecht | 416/241 A X |
| 4,258,947 | 3/1981 | Thompson et al. | 294/15 |
| 4,415,080 | 11/1983 | Romine et al. | 294/158 |
| 4,477,228 | 10/1984 | Duffy et al. | 416/241 A |

FOREIGN PATENT DOCUMENTS

| | | | |
|---|---|---|---|
| 204673 | 12/1983 | Fed. Rep. of Germany | 416/146 B |
| 385821 | 8/1973 | U.S.S.R. | 416/146 B |
| 686936 | 10/1979 | U.S.S.R. | 416/146 B |

OTHER PUBLICATIONS

REVO Propeller, Lee's Research and Development, Ltd., Oskaloosa, Iowa.

*Primary Examiner*—Everette A. Powell, Jr.
*Attorney, Agent, or Firm*—Andrus, Sceales, Starke & Sawall; Robert C. Curfiss

[57] ABSTRACT

A marine emergency spare propeller kit includes a plastic floating spare propeller (4) mounted on a carry handle (20) having an axial shaft (22) extending through the propeller hub (10) and retained thereon by a plastic floating nut (8) which is threaded identically to the propeller drive shaft (6) of the marine drive (2). Carry handle 20 also conveniently transports the damaged propeller after replacement by the spare.

3 Claims, 1 Drawing Sheet

MARINE PROPELLER CARRY HANDLE AND EMERGENCY SPARE KIT

BACKGROUND AND SUMMARY

The invention provides a convenient carry handle for a marine propeller. The invention also provides an emergency spare propeller kit for a marine drive.

In a marine drive, it is desirable to carry a spare propeller in the event of damage to the main propeller. However, the cost and weight of an extra propeller may be objectionable. It is known in the art to provide plastic or the like propellers, including floating propellers, which are lightweight and less costly than a regular metal propeller. The plastic propeller is not as rugged as a metal propeller. An advantage of the plastic propeller is that it floats, which facilitates changing of propellers in the middle of the lake. It is also known to include a metal insert in the hub for spline strength.

The present invention provides a convenient carry handle for a marine propeller. The present invention also provides a spare propeller kit which is particularly convenient to transport and stow in a boat, ready for use. The convenience of the kit encourages its usage, so that the boat operator will have a spare on hand and not be stranded in the middle of the lake.

DETAILED DESCRIPTION

Figure 1:
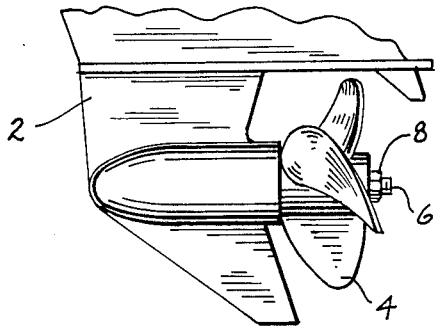
FIG. 1 is a side view of a lower portion of a marine drive, including a mounted propeller.

FIG. 1 shows a marine drive 2 having a propeller 4 for propelling the boat. Propeller 4 is mounted on propeller drive shaft 6 and retained thereon by nut 8.

Figure 3:
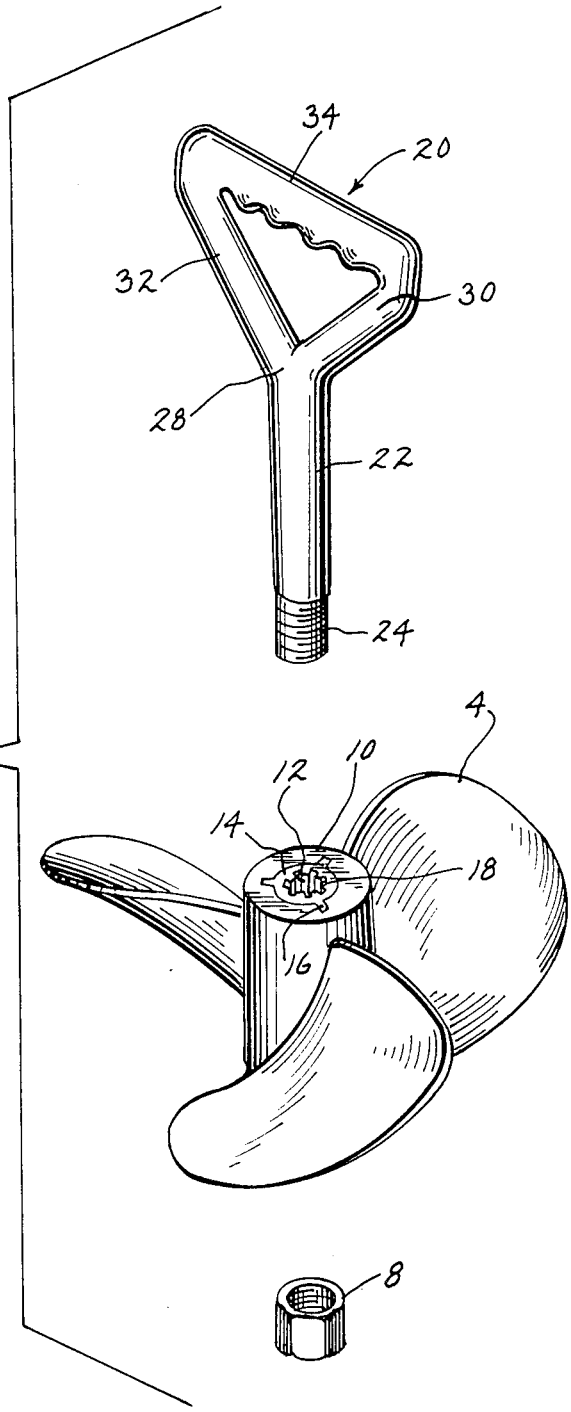
FIG. 3 is an exploded perspective view of the handle and kit of FIG. 2.
Figure 2:
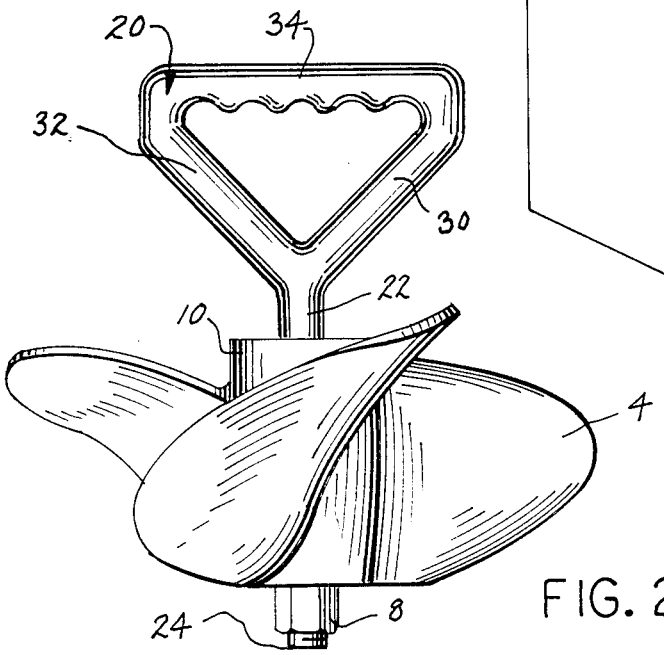
FIG. 2 is a side elevation view of a carry handle and a marine emergency spare propeller kit in accordance with the invention.

Propeller 4 is preferably made of a plastic or other suitable material of a density less than water such that it will float, for example polypropylene. Propeller 4 has a central hub 10, FIG. 3, with a central axial opening 12 therethrough for mounting to propeller drive shaft 6. An aluminum insert 14 is provided in axial opening 12 and has radial ears such as 16 for preventing rotation of insert 14 relative to hub 10. Insert 12 includes inner splines 18 mating with splined drive shaft 6 to be driven thereby.

A carry handle 20 has an axial shaft 22 extending through axial opening 12 of the propeller hub. The lower end 24 of axial shaft 22 is threaded and receives nut 26, which retains propeller 4 on shaft 22. The top end 28 of shaft 22 is Y-shaped and has upper legs 30 and 32 extending radially outwardly beyond axial opening 12. Bridge portion 34 extends between legs 30 and 32 and is gripped by the hand of the user. Propeller 4 is retained along shaft 22 between bottom nut 26 and upper handle legs 30 and 32.

The bottom end 24 of axial shaft 22 is threaded identically to propeller drive shaft 6. Nut 26 is preferably of a plastic material of lesser density than water, for example polypropylene, and hence floats. Floating nut 8 is removable from axial shaft 22 and usable to mount propeller 4 to drive shaft 6 if the original drive shaft nut sinks during the changing of propellers.

Carry handle 20 may be used to conveniently transport other types of propellers. Carry handle 20 is also conveniently used to transport the damaged propeller after replacement by the spare propeller.

The kit and handle may be used with various models and sizes of propellers, including through-hub-exhaust type propellers, and with various gearcase types.

It is recognized that various equivalents, alternatives and modifications are possible with in the scope of the appended claims.

We claim:

1. A marine emergency spare propeller kit comprising:

a plastic floating spare propeller having a central hub with a central axial opening therethrough for mounting to a propeller drive shaft to propel a boat;

a carry handle having an axial shaft extending through said axial opening through said hub;

means removably retaining said hub on said shaft, such that said propeller may be transported by the user by means of said carrying handle and stowed in the boat, ready for use, wherein said retaining means is at one end of said axial shaft, and wherein said carry handle includes a user grip portion at the other end of said axial shaft, wherein said drive shaft has a threaded end, and wherein said one end of said axial shaft of said carry handle is threaded identically to said drive shaft end, and wherein said retaining means comprises a plastic floating nut tightened on said threaded end of said axial shaft to retain said propeller thereon, said floating nut being removable from said axial shaft and usable to mount said propeller to said drive shaft if the original drive shaft nut sinks during the changing of propellers.

2. The invention according to claim 1 wherein said user grip portion at said other end of said axial shaft includes a leg extending radially outwardly beyond said axial opening, said spare propeller hub being retained between said floating nut on one side and said leg on the other side.

3. The invention according to claim 2 comprising a pair of said legs forming a Y-shape at said other end of said axial shaft, and a bridge extending between said legs and gripped by the hand of the user.

* * * * *